US011835203B2

(12) United States Patent
Vu Thi et al.

(10) Patent No.: US 11,835,203 B2
(45) Date of Patent: Dec. 5, 2023

(54) SURGICAL LIGHTING DEVICE FOR FLUORESCENT IMAGING

(71) Applicant: MAQUET SAS, Orléans (FR)

(72) Inventors: Minh-Hong Vu Thi, Orléans (FR); Sophie Santiago, Orléans (FR); Cécilia Valteau, Orléans (FR)

(73) Assignee: Maquet SAS, Orléans (FR)

( * ) Notice: Subject to any disclaimer, the term of this patent is extended or adjusted under 35 U.S.C. 154(b) by 0 days.

(21) Appl. No.: 17/929,516

(22) Filed: Sep. 2, 2022

(65) Prior Publication Data

US 2022/0412538 A1 Dec. 29, 2022

Related U.S. Application Data

(63) Continuation of application No. PCT/EP2021/072927, filed on Aug. 18, 2021.

(51) Int. Cl.
*F21V 14/08* (2006.01)
*F21V 9/04* (2018.01)
(Continued)

(52) U.S. Cl.
CPC ..... *F21V 14/08* (2013.01); *F21V 9/04* (2013.01); *F21W 2131/205* (2013.01); *F21Y 2115/10* (2016.08)

(58) Field of Classification Search
CPC . F21V 14/08; F21V 9/04; F21V 21/30; F21V 14/085; F21V 9/00; F21V 23/00;
(Continued)

(56) References Cited

U.S. PATENT DOCUMENTS 4,135,231 A * 1/1979 Fisher ..... F21V 19/02 362/269
4,994,945 A * 2/1991 O'Shea ..... F21V 5/02 362/268
(Continued)

FOREIGN PATENT DOCUMENTS

CN 208535764 U 2/2019
FR 2989876 A1 11/2013
(Continued)

OTHER PUBLICATIONS

PCT International Search Report and Written Opinion mailed in PCT/EP2021/072927 on Nov. 29, 2021, 16 pages.
(Continued)

*Primary Examiner* — Bao Q Truong

(57) ABSTRACT

This disclosure relates to a surgical lighting device for generating a spot of light on a surgical site for use in combination with a fluorescence imaging device. The lighting device comprises a support structure, a subsurface which may be coupled to the support structure to seal the lower surface of the device while allowing light to pass through and a plurality of light sources emitting white light and placed between the support structure and the subsurface. The device further includes a plurality of NIR (near infrared) filters, each NIR filter being associated with a light source and being configured to substantially prevent the transmission of wavelengths within a wavelength band from 680 nm to 900 nm, while minimizing the change in the color temperature of the light spot.

19 Claims, 7 Drawing Sheets

(51) Int. Cl.
*F21Y 115/10* (2016.01)
*F21W 131/205* (2006.01)

(58) Field of Classification Search
CPC .. F21V 33/00; F21V 33/0068; F21Y 2115/10; F21W 2131/205; F21W 2131/20; F21W 2131/202
See application file for complete search history.

(56) References Cited

U.S. PATENT DOCUMENTS

| | | | |
|---|---|---|---|
| 8,872,132 | B2 | 10/2014 | Moy et al. |
| 9,752,756 | B2 * | 9/2017 | Biertuempfel ..... B64D 47/02 |
| 10,258,275 | B2 | 4/2019 | Mahadevan-Jansen et al. |
| 10,579,891 | B2 | 3/2020 | Abbas et al. |
| 10,634,615 | B2 | 4/2020 | Rizo et al. |
| 10,986,999 | B2 | 4/2021 | Frangioni et al. |
| 11,002,680 | B2 | 5/2021 | Rizo et al. |
| 2008/0004533 | A1 | 1/2008 | Jansen et al. |
| 2013/0258661 | A1 | 10/2013 | Jousse et al. |
| 2015/0083932 | A1 | 3/2015 | Rizo et al. |
| 2019/0328232 | A1 | 10/2019 | Rizo et al. |
| 2020/0281475 | A1 | 9/2020 | Ahn et al. |
| 2020/0322552 | A1 | 10/2020 | Daures et al. |

FOREIGN PATENT DOCUMENTS

| | | | |
|---|---|---|---|
| KR | 20160147171 | A | 12/2016 |
| KR | 20160150519 | A | 12/2016 |

OTHER PUBLICATIONS

Search report issued in FR2008642 on Apr. 21, 2021, 12 pages.
Han et al., "A technique for near-infrared autofluorescence imaging of skin: preliminary results," Photonic Therapeutics and Diagnostics II,Proc. of SPIE vol. 6078, 60780S, (2006) · 1605-7422/06, 3 pages.
De Grand et al., "An Operational Near-Infrared Fluorescence Imaging System Prototype for Large Animal Surgery," Technology in Cancer Research & Treatment, ISSN 1533-0346, vol. 2, No. 6, December (2003), 10 pages.
Ogata et al., "Intraoperative Lymphography Using Indocyanine Green Dye for Near-Infrared Fluorescence Labeling in Lymphedema," Annals of Plastic Surgery · vol. 59, No. 2, Aug. 2007, 5 pages.

* cited by examiner

SURGICAL LIGHTING DEVICE FOR FLUORESCENT IMAGING

RELATED FILINGS

Benefit and priority are claimed to International application PCT/EP2021/072927 (filed Aug. 8, 2021), and French application FR2008642A (filed Aug. 24, 2020).

TECHNICAL FIELD

This disclosure relates to a surgical lighting device for use with a fluorescence medical imaging system.

BACKGROUND

Fluorescence medical imaging is a technique used during surgical procedures to help a surgeon locate a target organ or tissue in a patient. The technique consists of illuminating an area of interest with an excitation wavelength designed to cause certain molecules to fluoresce. Generally, the light emitted by molecules has a slightly longer wavelength than the excitation light. The molecules may be injected into the patient beforehand as a fluorescent marker. With an excitation light of an appropriate wavelength, endogenous molecules, i.e., molecules naturally present in the organism, may also be made to fluoresce depending on the metabolic state of the tissues. This last technique is called auto-fluorescence.

Today, fluorescence medical imaging is widespread, and a number of devices are available on the market. In some cases, these devices operate in the near-infrared wavelength range, i.e., the excitation light and the detected light are both in the wavelength range from 700 nm to 900 nm. The intensity of the fluorescence is relatively weak. It is therefore important to minimize stray light in the detected wavelengths.

Operating rooms are generally equipped with surgical lighting that complies with recognized standards that define the characteristics of the light emitted. For example, the NF EN 60601-2-41 standard specifically requires that surgical lights emit white light with a color temperature (Tk) between 3000K and 6700K and a general color rendering index (CRI) (or Ra) greater than or equal to 85. In addition, a suitable R9 should be available. The color temperature and CRI of the emitted light are important to allow the surgeon to see color shades correctly while reducing eye strain. Partly because of these constraints, most light sources used in surgical lighting emit light partly in the wavelength range detected by fluorescent medical imaging devices. For this reason, it is common to turn off the surgical light when using a fluorescence medical imaging device so as not to disturb the detection of the fluorescence signal or to manipulate it so that it does not further illuminate the area of interest.

FR 2989876 describes a fluorescence medical imaging system for operating rooms in which an operating light and the imaging detector are both fitted with filters so that operating light may remain on and directed to the area of interest during the fluorescent imaging operation without interfering with fluorescence detection. The filter for surgical lighting is attached to the outside of the lamp and covers its entire surface, i.e., approximately 0.5 $m^2$. The authors recognized that a filter of this size would be prohibitively expensive to manufacture with the required accuracy. Consequently, the filter does not exclude all the light within the field of the fluorescence image. For this reason, it was necessary to pair this filter with an additional filter on the fluorescence imaging detector to avoid interference. Such an arrangement is therefore only possible with a suitable detector. In addition, the detector filter inevitably attenuates the detectable signal. Furthermore, attaching such a filter to a surgical light is not without complications, since surgical lights must have a surface that may be efficiently and easily cleaned.

SUMMARY

The purpose of this disclosure is to alleviate the problems associated with the prior art and, more specifically, to propose a surgical lighting device that can remain operative to provide visible white light, particularly bright overhead white light, when a fluorescence medical imaging device is used, without disturbing the detected fluorescence signal. This disclosure also aims to provide an operating lighting device that may be operational during fluorescence medical imaging, regardless of the imaging device used.

This and other objectives are achieved in an operative lighting device for generating a light spot at an operative site for use in combination with a fluorescence imaging device, wherein the lighting device comprises a support structure, a subsurface that may be coupled to the support structure to seal the subsurface of the device while allowing light to pass through and the plurality of light sources positioned between the support structure and the subsurface being capable of emitting white light, the device further comprising a plurality of NIR filters, each NIR filter being associated with a light source and being configured to substantially prevent transmission of wavelengths within a wavelength band of approximately 680 nm to 900 nm while minimizing change in the color temperature of the light spot. Each of the NIR filters is also arranged to move between an active position, in which it is located in front of a light source to filter the light emitted by said light source, and an inactive position in which it is not able to filter the light coming from the light source. The device further comprises a control unit configured to control movement of the plurality of NIR filters between active and inactive positions, and the means to receive signals from a fluorescence imaging device, the control unit being configured to control movement of the NIR filters between the active position and the inactive position based on a signal indicating that the fluorescence imaging device has been activated or as a function of a signal received from the fluorescence imaging device.

The installation of a plurality of NIR filters, that is to say filters which suppress the transmission of wavelengths in the near infrared, each being associated with a light source, makes it possible to maintain the size of the filter at a reduced level and therefore improve the accuracy of the filter to effectively block any stray light in the near infrared range at a cost that remains reasonable. Accordingly, the device may be used with commercially available fluorescence imaging devices without the need for additional modifications. Enclosing the filters in the sealed lighting device further facilitates cleaning of the device. As any filtering of light will cause some change in the color temperature of the light spot, controlled deployment of the filters in this way allows the surgeon to select the optimal light for their needs. In addition, the automatic control of the positions of the filters using a signal indicating the state of a fluorescence imaging device facilitates considerably the activation of the filters while ensuring optimal illumination regardless of it being based on the operational character of the fluorescence imaging or not.

Preferably, the device comprises a plurality of optical elements configured to collect, focus and/or concentrate light from said light sources, wherein the plurality of NIR filters is disposed in at least one of the following positions: between the light sources and the optical elements, on a surface of the optical elements facing the light source, on a surface of the optical elements facing away from the light source, between the optical element and the subsurface and on a surface of the subsurface. The filters may thus be installed in any surgical lighting device, regardless of the structure.

In an advantageous embodiment, the NIR filters are included in the subsurface or in the optical elements. This may be achieved by applying one or more thin layers to the underlying element, through a surface treatment of this element or by bonding to the underlying element a separate optical component having the absorption properties required in the near infrared wavelength range.

According to an advantageous embodiment, the control unit is configured to communicate with a control panel; the control unit being configured to control the movement of the NIR filters between the active position and the inactive position according to a signal from the control panel. The control panel may be mounted on the lighting device, for example fixed on the outside of the support structure, which is to say on the housing of the device. Alternatively, the control unit may be configured for wired or wireless communication with the control panel to allow remote control of filter positions.

In a particularly advantageous arrangement, a plurality of NIR filters is positioned on a rotating disc, in which the rotation of said disc is controlled by said control unit. For example, a plurality of NIR filters might be placed on a rotating disc with other optical elements or empty spaces alternating with the NIR filters. In some cases, the active position corresponds to the alignment of NIR filters on the rotating disc with a plurality of light sources, and the inactive position corresponds to the alignment of other optical elements or empty spaces on the optical disc with the light sources. In this way, several filters may be activated or deactivated in a single movement.

Preferably, the rotating disk is rotated automatically to bring the lighting device into the active configuration based on a signal indicating that the fluorescence imaging equipment has been activated.

In preferred embodiments, each NIR filter has a transmittance of at most ≤0.5%, preferably 0.1%, and more preferably 0.01% in the substantially blocked wavelength band, and a transmittance of ≥85% from 400 nm to substantially blocked wavelengths.

In a particularly advantageous embodiment, when the NIR filters are in front of the respective light sources, the lighting device provides central lighting (Ec) of at least 40,000 lux at the center of a light spot one meter from the face of the operating light output, while also providing a transmittance of at most s 0.5%, preferably at most 0.1%, and more preferably at most 0.01% in a wavelength band of at least 50 nm between the wavelengths of 680 nm and 900 nm.

Preferably, the light sources of the surgical lighting device comprise at least one LED.

In certain embodiments, the lighting device having a maximum central lighting (Ec) of 160 Klux has an irradiance in the 700 nm to 750 nm wavelength band of at most 1000 $mW/m^2$.

In certain embodiments, the lighting device having a maximum central lighting (Ec) of 160 Klux has an irradiance in the 750 nm to 850 nm wavelength band of at most 100 $mW/m^2$, and preferably at most 50 $mW/m^2$.

According to another embodiment, a surgical lighting device for generating a spot of light on a surgical site for use in combination with a fluorescence imaging device is proposed, said lighting device comprising a support structure, a subsurface that may be coupled to the support structure to seal the subsurface of the device while allowing light to pass through and a plurality of light sources emitting white light and positioned between said support structure and the subsurface, the device further comprising a plurality of NIR filters, each NIR filter being associated with a light source and being configured to substantially prevent the transmission of wavelengths within a 680 nm to 900 nm wavelength band, while minimizing the color temperature change of the light spot such that the lighting device having central lighting maximum (Ec) of 160 Klux has an irradiance in the wavelength band 700 nm to 750 nm of at most 1000 $mW/m^2$.

It is understood that the different embodiments described above may be combined with each other.

BRIEF DESCRIPTION OF DRAWINGS

This disclosure will be better understood, and its other advantages will appear, upon reading the detailed description of an embodiment taken by way of non-limiting example and illustrated by the appended drawings in which.

DETAILED DESCRIPTION

Figure 1:
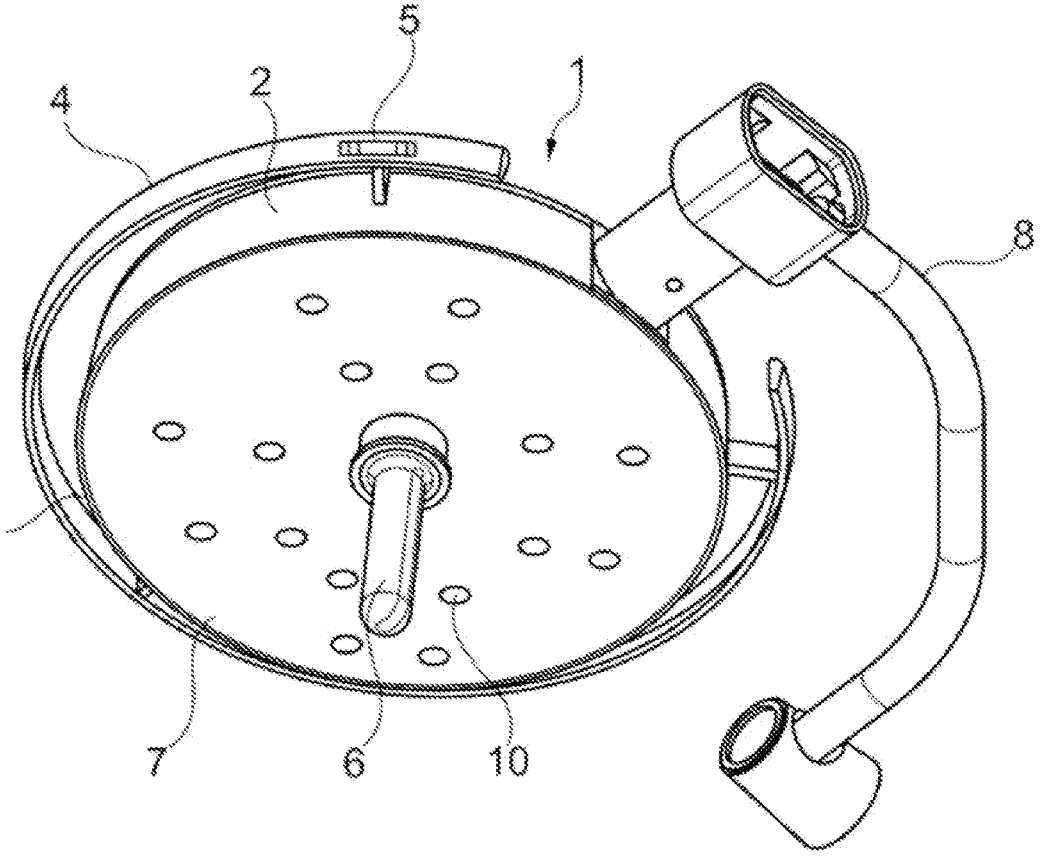
FIG. 1 illustrates a lighting device in accordance with this disclosure.

In the drawings, the same reference numerals are used for the same elements.

FIG. 1 illustrates a surgical lighting device 1 according to this disclosure. The lighting device 1 illustrated is a lamp head which may be used in a surgical light assembly, either with other lamp heads or alone. The surgical lighting device 1 has a shell or housing 2, which forms the rear of the lamp head. The housing serves as a support structure 2 for the various optical and electronic elements of the lighting device, alone or with other structural elements. The housing 2 may be coupled to an articulated arm 8 allowing suspension from the ceiling of an operating room. It may also be coupled to a mobile or fixed support. The housing 2 is essentially dome-shaped with a non-visible rear surface and a rim 3 extending perpendicularly to this rear surface and accommodates the various optical and electrical elements for the production of light. A laterally extending handle 4 for manipulation and positioning of the lighting device 1 is connected to the rim. A control panel 5 in the form of a keyboard, a touch screen or the like is mounted on the handle 4 to control the various functions of the lighting device, as described later. It should be noted that the handle 5 may take different forms or be completely omitted. Also, the control panel 5, if present, may be located on the case or on a separate controller. The lighting device 1 further comprises a cover or sub-face 7, at least partially transparent, to let the light through, which fits on the subsurface of the housing 2 in watertight contact with the rim 3 and forms a surface of light emission from the lighting device. A tubular handle 6, sterile, may also be provided on the subsurface of the lighting device, substantially in the center of this light-emitting surface or on the side, to allow manipulation of the device with one hand.

Although the housing 2 and the subsurface 7 illustrated in the figures have an essentially circular cross-section, it is understood that this is only an illustration. The lighting device 1 may be applied to lamps of various shapes and structures, including a cruciform shape or another branched shape.

Fluorescence imaging is used during the operation to help the surgeon identify specific structures or tissues. Fluorescence imaging devices may be hand-held or attached to a stand or the like in an operating room. The device works by emitting light to induce fluorescence in molecules in the body. Often, molecules are labeled by first injecting a label into the patient, but some natural or endogenous molecules may fluoresce under appropriate excitation light. The wavelength of light emitted and detected by fluorescent imaging devices is often in the near infrared range, with excitation light typically emitted at a wavelength between about 700 and 800 nm and the fluorescence being detected at a higher wavelength of approximately 20 to 80 nm.

Figure 2:
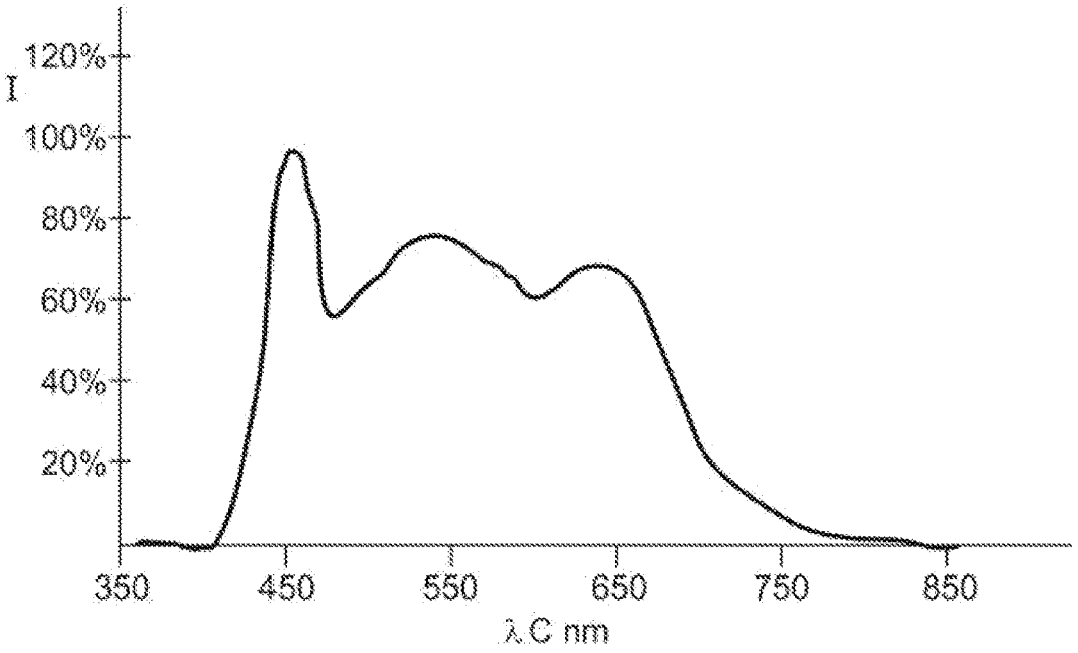
FIG. 2 is a diagram showing the emission spectrum of a white LED.

The light sources used in a surgical lighting device should preferably be able to generate white light in accordance with the applicable standard. For example, the NF EN 60601-2-41 standard requires that surgical lights emit white light with a color temperature (Tk) between 3000K and 6700K and a general color rendering index (CRI) greater than or equal to 85. Halogen light sources have been used in surgical lights, but LEDs are more commonly used today due to their efficiency and low heat dissipation. FIG. 2 illustrates a typical emission spectrum of a white LED suitable for surgical lamps, showing the relative intensity I emitted by the LED as a function of the wavelength $\lambda$. It is apparent from this emission spectrum that the emitted light extends into the near-infrared region and specifically overlaps the operational wavelength region of fluorescence imaging devices. The intensity of the fluorescence is relatively weak. Therefore, this light is sufficient to seriously interfere with fluorescence detection when used in conjunction with that of a fluorescence imaging device. It should be noted that the focusing and/or concentration optics as well as the subsurface are substantially transparent to radiation in the wavelengths from visible light to near infrared, so that the spectrum of the light spot at 1 meter of the lighting layout will resemble the LED spectrum but with reduced intensity. However, the intensity in the near infrared wavelengths is still more than enough to interfere with fluorescent light detection.

To avoid this disturbance while allowing the use of the surgical lighting device during the operation of a fluorescence medical imaging device, it is proposed to filter the light emitted by each light source using a filter which is designed to block wavelengths at least in the near-infrared range while ensuring that the transmitted white light meets the standard's color temperature and color rendering index (CRI) requirements. In particular, the filter can ensure that in the field illuminated by the surgical lighting device, the spectral irradiance in the near infrared, and more particularly at the wavelengths used by a fluorescence medical imaging device, i.e., are less than approximately 0.1 W/m2/nm. In this disclosure, these filters will be referred to as NIR filters.

Figure 3:
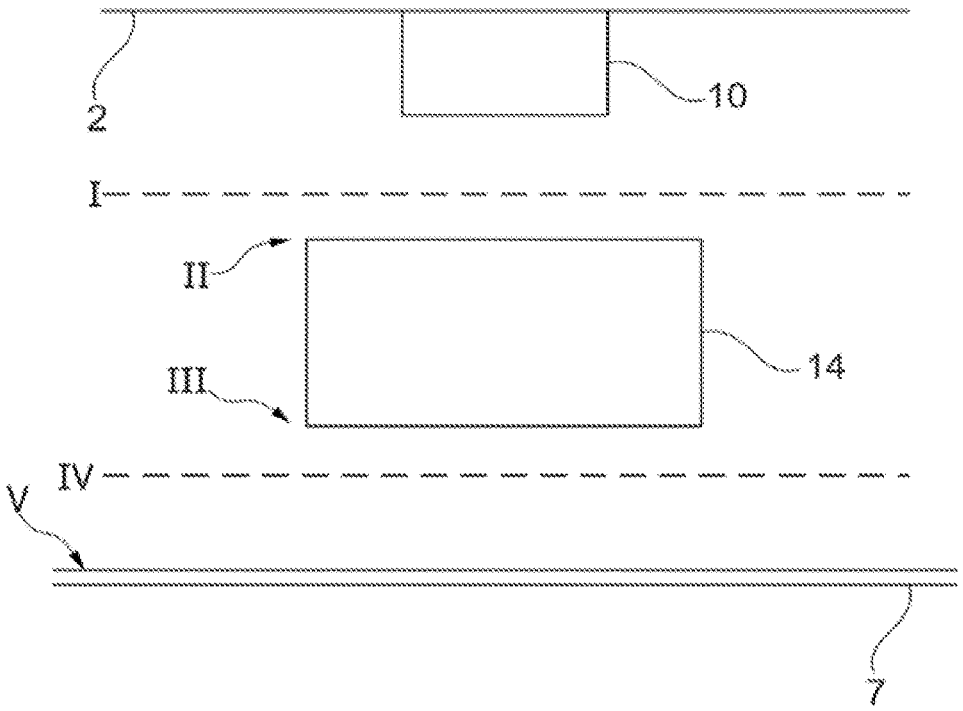
FIG. 3 schematically illustrates the possible location of the filters in the surgical lighting device of FIG. 1.

FIG. 3 shows a schematic representation of part of a surgical lighting device with an NIR filter. We see in FIG. 3 a light source 10, an optical element 14 positioned and configured to collect and concentrate the light emitted by the light source 10 and the subsurface 7. An NIR filter may be placed in different positions in this device. These positions are indicated by the Roman numerals I to V in the Figure. More precisely, the NIR filter may be placed between the light source 10 and the optical element 14, designated by the position I. The NIR filter may be located either on the input surface II, or on the output surface III of the optical element 14. In this case, the NIR filter may be obtained by means of a surface treatment of the optical element 14. The NIR filter may be placed between the optical element 14 and the subsurface 7 in position IV. Finally, the NIR filter may be formed on the surface of the subsurface, for example, by means of a surface treatment on the subsurface as illustrated by position V. The placement of the NIR filtering means within the surgical lighting and adapted to filter light from a single light source makes it possible for each filter to be very small. This makes it possible to use more precise manufacturing methods, which in turn allow more precise filters to be produced at a significantly reduced cost.

Figure 4:
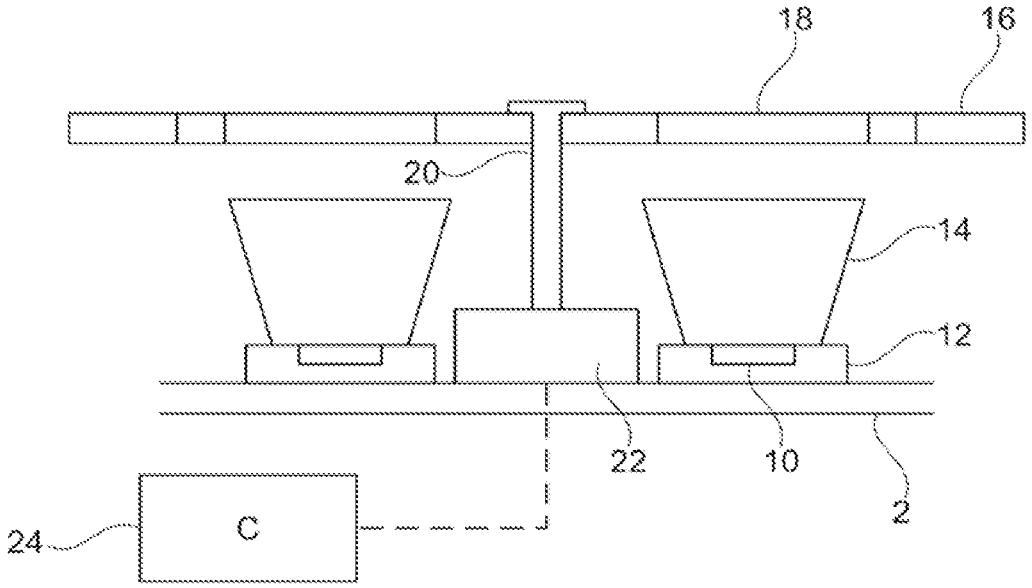
FIG. 4 shows a partial sectional view of the lighting device through plane AA of FIG. 1.

FIG. 4 shows a partial sectional view of the interior of the lighting device 1 through the plane AA of FIG. 1. FIG. 4 shows two light sources 10, which are mounted inside the housing 2 by means of connectors 12 which, in turn, are fixed to the housing 2. The connectors 12 may be part of one or more larger structural elements adapted to hold the various optical and/or electronic elements in place. It is also possible to mount the light sources and associated optics and circuits directly on the housing. To accommodate all possible modalities, the housing and any structural member considered part of the support structure in this disclosure are collectively referred to as the support structure 2 in this disclosure. The light sources 10 may be of any type but are preferably LED light sources. Above each light source there is an optical element 14 in the form of a collimator which is known per se to direct the luminous flux of the light sources towards the lighting field. The optical elements 14 are also anchored to the housing by suitable means, either directly or via the connectors. Other structures such as radiators (heat sinks) or light source control circuits may also be present but are not shown here. Interposed filtering means placed between the optical elements 14 and the subsurface 7 are in the form of a disc 16 which is rotatably installed on a shaft 20 of a motor 22. The filter disc 16 may be of substantially transparent material, the filter elements 18 being placed so as to match the positions of the light sources 10. The motor 22 is controlled by a control unit 24 to rotate, and thus bring the filter elements 18 into an active position above the light sources 10, or to move the filter elements 18 into an inactive position away from the light sources 10.

Filter disk 16 may optionally include open spaces or alternative optical elements other than NIR filter elements (not shown) that are aligned with light sources 10 in the inactive position. The open spaces or alternative optical elements may be placed alternately with the NIR filter elements 18 on the filter disc 16. In such a placement, disc 16 may be partially or substantially opaque in the areas located outside the light transmission areas.

It will be appreciated that one or more filter discs 16 may be placed between the light sources 10 and the optical elements 14, i.e., at position I in FIG. 3. Al-though the NIR filters 18 ensure that the spot of light generated conforms to the standard applicable to surgical light, they may nevertheless modify the color temperature of the light. A surgeon may selectively activate or deactivate the filtering elements 18, and thus select the lighting most appropriate to the surgeon's needs.

Figure 5:
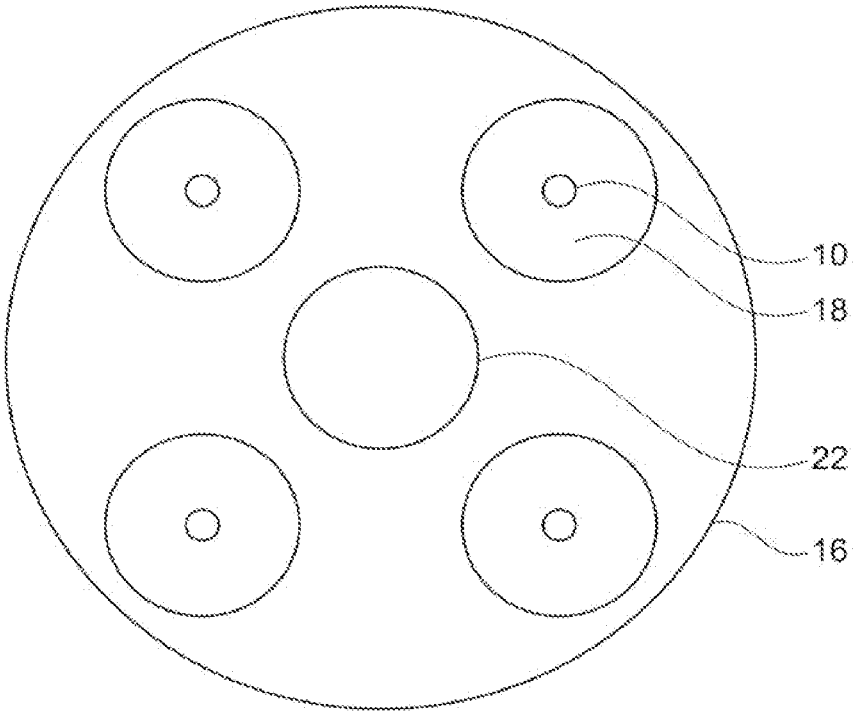
FIG. 5 schematically illustrates a filter disc according to an embodiment.

FIG. 5 shows a plan view of a filter disc 16 provided with four filter elements 18, each positioned to filter light from one of the four light sources 10, which may be perceived through the filter elements 18. The filter disc 16 has an essentially circular shape, but other shapes are also possible. In addition, it will be understood that the filter disc may comprise more or fewer filter elements 18 and therefore be arranged above more or fewer light sources 10 depending on the particular structure of the lighting device. Several filter discs 16 may be arranged within the same lighting device 1 to make filtering of several light sources possible. For example, in the lamp head shown in FIG. 1, which has a total of sixteen light sources, four filter discs 16 may be positioned and controlled collectively.

Figure 6:
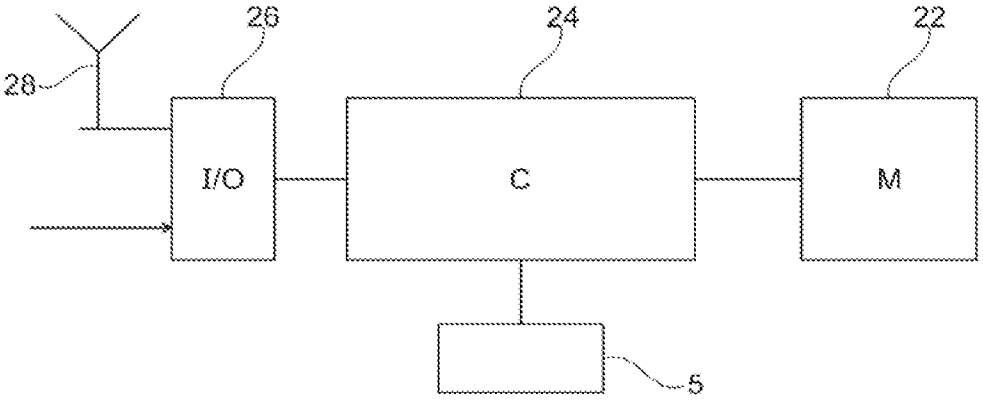
FIG. 6 is a functional diagram illustrating the control of the lighting device.

FIG. 6 is a block diagram illustrating control of the NIR filters 18. Control unit 24 is connected to motor 22 which drives shaft 20 to rotate filter disc 16 between an active position and an inactive position. Control unit 24 is connected to control panel 5 (FIG. 1) and receives manual commands via control panel 5 but may also send information for display. Control panel 5 may also be configured for non-contact operation, for example, by voice command. Control unit 24 may control other functions of the lighting installation, including switching on and off. The functions of the lighting device may be additionally or alternatively controlled by a remote-control device which communicates wirelessly with lighting device 1. Control unit 24 is further connected to a control module input/output (I/O) 26 capable of receiving signals from external devices. These signals may be received via a wired or wireless connection, for example, via an antenna 28, infrared or another suitable interface. In this way, a fluorescence medical imaging device may be coupled to lighting device 1 to allow the automatic deployment of filter elements 18 by control unit 24 when the imaging device is activated. In order to guarantee absence of stray light in the operating field when using a fluorescence medical imaging device, it is also possible for the lighting device to generate, via control unit 24 or by means of a remote control device, a signal for controlling all other light sources in an operating room. Such a signal may also be generated in response to a signal from a fluorescence imaging device, such that activation of the imaging device automatically triggers both the deployment of filters in the active position in the device and surgical light 1 and the simultaneous switching off of all the other lights in the operating room.

Figure 7:
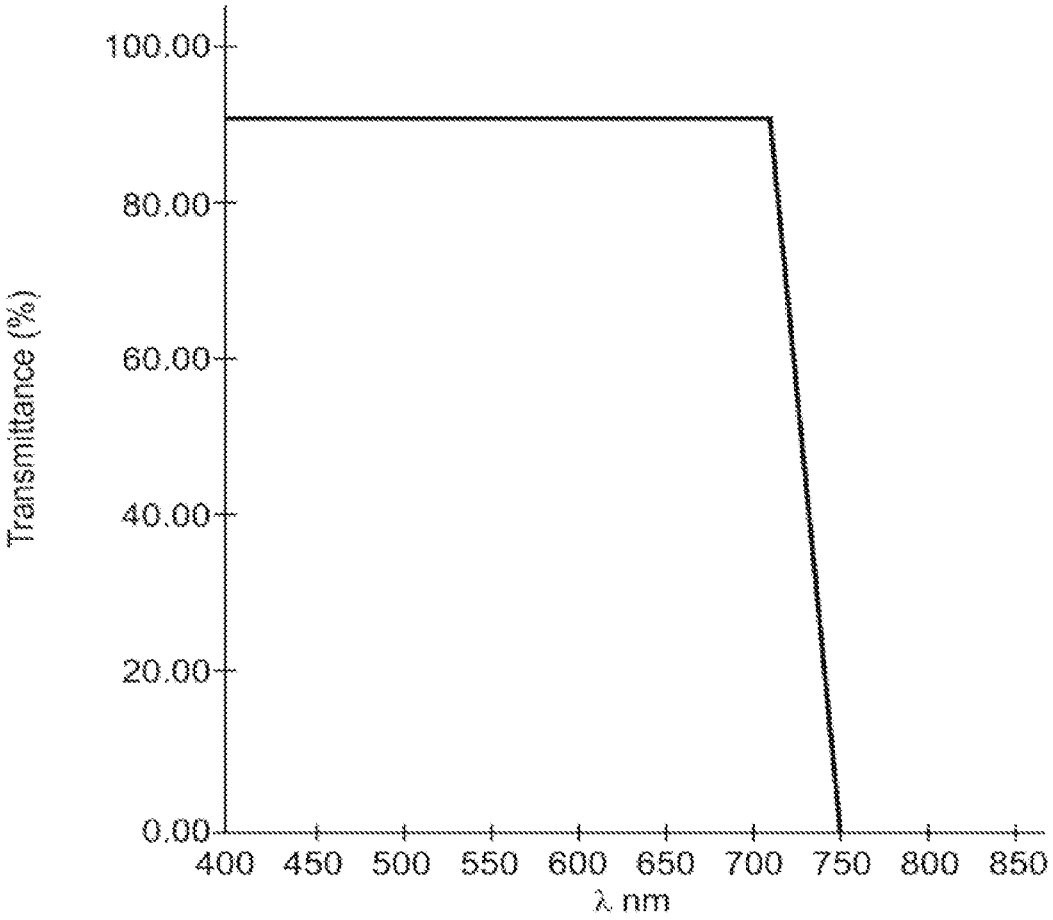
FIG. 7 schematically shows a transmission curve of an NIR filter of the lighting device of FIGS. 1 and 2 according to a preferential embodiment.

FIG. 7 shows the transmission curve of an example of an NIR filter fitted to the surgical lighting device of this disclosure. The filter is characterized by a transmittance of ≥85% at wavelengths from 400 nm to 710 nm, a transmittance of 50% at 730 nm and a transmittance of ≤0.01% at 740 nm to 900 nm at an angle of incidence of 30°. Experiments with this filter in different surgical light configurations have yielded light spots with a correlated color temperature of approximately 5100K and a color rendering index of 93-95. More generally, NIR filters preferably block light having a wavelength equal to or greater than a blocking wave-length, this blocking wavelength preferably being in the range of 680 nm to 740 nm. Preferably, light blocking is understood to mean a transmittance of ≤0.5%, more preferably ≤0.1% and even more preferably ≤0.01%. Further, the filters can block light having a wave-length range that extends at least 50 nm, preferably at least 100 nm and more preferably at least 200 nm from the blocking wavelength. The filter further has a transmittance of ≥85% for visible light, i.e., for wavelengths ranging from 400 nm to the blocking wavelength. In preferred embodiments, the maximum central lighting (Ec) is at least 40,000 lux or at least 60,000 lux at the center of the light spot, one meter from the exit surface of the operating light, while providing transmission of ≤0.5% or ≤0.1% or ≤0.01% above the blocking wave-length described above.

Figure 8:
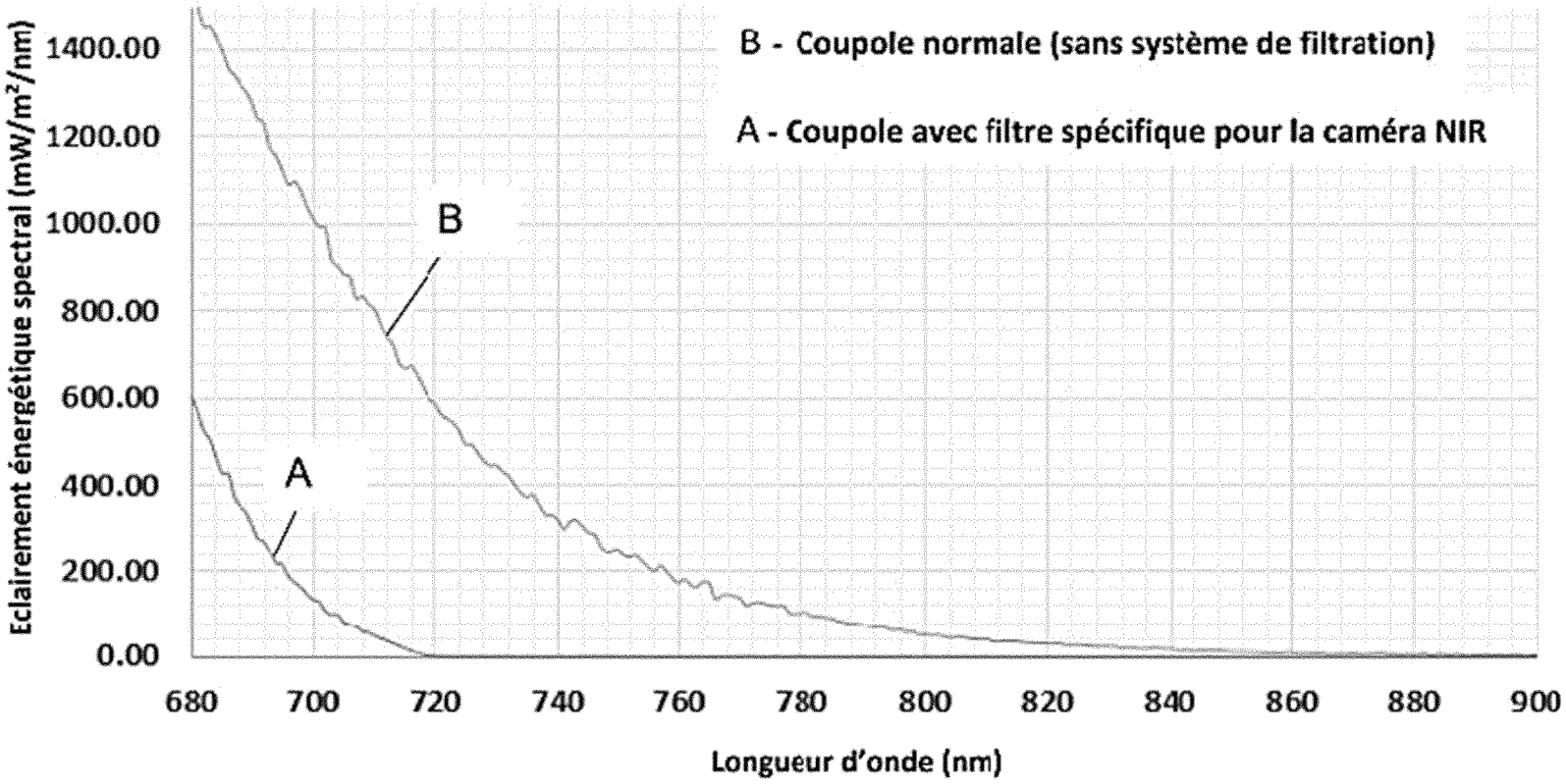
FIG. 8 schematically shows the power lighting of a surgical lighting device with NIR filters and a surgical lighting device without filter.

FIG. 8 presents a graph illustrating the spectral irradiance of a lighting device equipped with an improved NIR filter (curve A) and of a filter-less lighting device (curve B). In both cases, the spectral irradiance of the lighting device was measured using a JETI Spec-bos1211 type spectrometer (calibrated and COFRAC certified) configured to measure the spectral irradiance at the center of a light spot at a distance of 1 m from the device for the wavelengths of interest. The values are normalized for a maximum central lighting of the device of 160 Klux). It may be seen that the device without filter exhibits significant irradiance at wavelengths greater than 720 nm, with spectral irradiance at 800 nm of about 60 mW/m$^2$. On the other hand, the device with the NIR filter achieves an almost complete suppression of luminous power at wavelengths greater than and equal to 720 nm, and a spectral irradiance of approximately 120 mW/m$^2$ at 700 nm.

However, when considering the impact of irradiance on fluorescence detection, it is more useful to refer to the total irradiance emitted in a wavelength band of interest than to spectral irradiance, i.e., the irradiance at an individual wavelength. The table below gives the sum of the measured spectral irradiance values for different wavelength bands.

| Wavelength Band | Ee (mW/m$^2$) normalized for Ec 160 Klux |
|---|---|
| 700 to 750 nm | 710 |
| 710 to 750 nm | 70 |
| 750 to 850 nm | 19 |
| 800 to 870 nm | 17 |

More commonly, it is preferable that the lighting device having a maximum central lighting (Ec) of 160 Klux have an irradiance for the wavelength band 700 nm to 750 nm of at most 1000 mW/m$^2$ and preferably at most 800 mW/m$^2$. Preferably, the lighting device has an irradiance of at most 100 mW/m2 for the 710 nm to 750 nm wavelength band and an irradiance for the 750 nm wavelength band at 850 nm at most 100 mW/m$^2$, and more preferably at most 50 mW/m$^2$.

The filter elements 18 may be of any suitable material, including but not limited to plastic, silicone, and glass or a combination thereof, and may be of the dichroic or absorbent type. Filter elements may be manufactured by surface treatment of materials, including but not limited to the sol-gel process, the application of absorbent powder at the time of the material injection, and the deposition of thin layers under vacuum. The filter element 18 may also be formed as a separate optical element in the form of a plate or disc which is glued or otherwise fixed to subsurface 7 or to optical elements 14.

Embodiments may include surgical lighting device (1) for generating a light spot at a surgical site for use in combination with a fluorescence imaging device, said lighting device (1) comprising a support structure (2), a subsurface (7) which may be coupled to the support structure (2) to seal the subsurface of the device while allowing light to pass through and a plurality of light sources (10) emitting white light and arranged between said support structure (2) and the subsurface (7), the device further comprising a plurality of NIR filters (18), each NIR filter being associated with a light source (10) and being configured to substantially prevent transmitting wavelengths within a wavelength band of 680 nm to 900 nm while minimizing the change in the color temperature of the light spot, with each of the NIR filters (18) also being positioned in a mobile fashion between an active position, in which they are located in front of a light source (10) to filter the light emitted by said light source (10), and in an inactive position in which filtering the light coming from the light source (10) is not possible. The device further comprises a control unit (24) configured to control movement of the plurality of NIR filters (18) between active and inactive positions. The device further comprises a means (26; 28) to receive signals from a fluorescence imaging device. The control unit (24) is configured to control the movement of the NIR filters (18) between the active and the inactive position in accordance with a signal indicating that the fluorescence imaging device has been activated.

The system may include a plurality of optical elements (14) configured to collect, focus, and/or concentrate light from said light sources (10), and wherein the plurality of NIR filters (18) is placed in at least one of the following positions: between the light sources and the optical elements (14), on a surface of the optical elements (14) facing the light source (10), on a surface of the optics facing away from the light source (10), between the optical element and the subsurface (7) and on a surface of the subsurface (7).

In some embodiments the filters (18) are included in the said subsurface (7). The filters (18) may be included in the optical elements (14).

Control unit (24) may be configured to communicate with a control panel (5), the control unit (24) being configured to control the movement of the NIR filters (18) between the active position and the inactive position according to a signal from the control panel. The control panel (5) can be mounted on the lighting device, or elsewhere. The control unit may be configured to communicate wirelessly with the control panel (5).

In some embodiments a plurality of NIR filters (18) is placed on a rotating disk (16), and the rotation of the disk (16) can be controlled by said control unit (24).

In some embodiments a plurality of NIR filters (18) are placed upon a rotating disc (16) in an alternating pattern with a plurality of open spaces or a plurality of optical elements other than the NIR filters; wherein the rotation of the rotating disc changes the lighting device between an active configuration, wherein the plurality of NIR filters is located in front of respective light sources (10) to filter the light emitted by said light source (10) during a fluorescence imaging procedure, and an inactive configuration in which light from said light source (10) does not pass through an NIR filter. In some embodiments the rotating disk is automatically rotated to bring the lighting device into the active configuration based on a signal indicating that the fluorescence imaging device has been activated.

The light sources (10) can comprise at least one LED, or other lights sources.

In some embodiments, each NIR filter has a transmittance of at most ≤0.5%, preferably 0.1%, and more preferably 0.01% in the band of substantially blocked wavelengths. Preferably each NIR filter also has a transmittance of ≥85% from 400 nm up to the substantially blocked wavelengths.

In the embodiments described above, the plurality of NIR filters (18) can be in front of the respective light sources (10), the lighting device providing central lighting (Ec) of at least minus 40,000 lux at the center of a light spot one meter from the exit side of the operating light, while also providing a transmittance of not more than ≤0.5%, preferably not more than 0.1%, and most preferably 0.01%, in a wavelength band of at least 50 nm located between the wavelengths of 680 nm and 900 nm.

Preferably the wavelength band spans at least 50 nm, or more preferably at least 100 nm or at least 200 nm.

A transmission band of the NIR filters refers to a band of wavelengths where the NIR filters have high transmittance, such as at least 85% transmittance. The transmission band may spanning at least from 400 nm up to approximately a lower limit of the wavelength band. For example, the transmission band may span at least from at least 400 nm up to approximately 30 nm below a lower limit of the wavelength band (as shown in FIG. 7), or at least from about 400 nm up to a transmission band upper limit which is less than 50 nm or less than 100 nm below a lower limit of the wavelength band. Thus in some useful embodiments, the upper limit of the transmission band will be a bit below the lower limit of the wavelength band, owing to a transitional zone between high and low transmission in many NIR filters. See, again, FIG. 7 as an example.

In some embodiments, the lighting device has a maximum central lighting (Ec) of 160 Klux, and/or an irradiance in the 700 nm to 750 nm wavelength band of at most 1000 mW/m2.

In some embodiments the lighting device has a maximum central lighting (Ec) of 160 Klux, and/or an irradiance in the 750 nm to 850 nm wavelength band of at most 100 mW/m2, and preferably of at most 50 mW/m2.

The specific characteristics mentioned above are only variants of a non-limiting nature. The characterizations mentioned herein are all contemplated and disclosed in their various possible combinations and sub-combinations, as would be understood by a person skilled in the art in this technology.

LIST OF REFERENCE NUMBERS

1 Surgical Lighting Device
2 Housing/Support Structure
3 Rim
4 Handle
5 Control Panel
6 Sterile Handle
7 Cover/subsurface
8 Articulated Arm
10 Light source
12 Connector
14 Optical Element
16 Filter Disc
18 Filter
20 Shaft
22 Motor
24 Control Unit
26 I/O module
28 Antenna

The invention claimed is:

1. A surgical lighting device (1) for generating a light spot at a surgical site for use in combination with a fluorescence imaging device, said lighting device (1) comprising:

a support structure (2), a subsurface (7) coupled to the support structure (2) to seal the subsurface of the device while allowing light to pass through, a plurality of light sources (10) for emitting white light, and arranged between said support structure (2) and the subsurface (7), a plurality of NIR filters (18), each of the plurality of NIR filters being associated with a light source (10) and being configured to substantially prevent transmitting wavelengths within a wavelength band, the wavelength band falling between 680 nm to 900 nm, wherein each of the plurality of NIR filters (18) is movable between (i) an active position, in which the respective NIR filters are each located in front of a light source (10) to filter the light emitted by said light source (10), and (ii) an inactive position in which the plurality of NIR filters do not filter the light coming from the light sources (10), the device further comprising a control unit (24) configured to control movement of the plurality of NIR filters (18) between said active and inactive positions and a means (26; 28) to receive signals from a fluorescence imaging device, wherein the control unit (24) is configured to control movement of the plurality of NIR filters (18) between the inactive position and the active position in accordance with a signal indicating that the fluorescence imaging device has been activated.

2. Surgical lighting device according to claim 1, further comprising a plurality of optical elements (14) configured to collect, focus, and/or concentrate light from said light sources (10).

3. Surgical lighting device according to claim 1, wherein the filters (18) are included in the said subsurface (7).

4. Surgical lighting device according to claim 2, wherein the filters (18) are included in or on the optical elements (14).

5. Surgical lighting device according to claim 1, wherein the control unit (24) is configured to communicate with a control panel (5), the control unit (24) being configured to control the movement of the NIR filters (18) between the active position and the inactive position according to a signal from the control panel.

6. Surgical lighting device according to claim 5, wherein the control panel (5) is mounted on the lighting device.

7. Surgical lighting device according to claim 5, wherein the control unit is configured to communicate wirelessly with the control panel (5).

8. Surgical lighting device according to claim 1, wherein the plurality of NIR filters (18) are on a rotatable disk (16), and wherein the rotation of the rotatable disk (16) is controlled by said control unit (24).

9. Surgical lighting device according to claim 1:

wherein the plurality of NIR filters (18) are placed on a rotatable disc (16) in an alternating pattern with a plurality of open spaces or a plurality of optical elements other than the NIR filters; and wherein rotation of the rotatable disc changes the lighting device between (i) an active configuration wherein the plurality of NIR filters are located in front of respective light sources (10) to filter the light emitted by said light sources (10) during a fluorescence imaging procedure, and (ii) an inactive configuration in which light from said light source (10) does not pass through any of said plurality of NIR filters.

10. Surgical lighting device according to claim 9, wherein the rotatable disk is automatically rotated to bring the lighting device into the active configuration in response to a signal indicating that the fluorescence imaging device has been activated.

11. Surgical lighting device according to claim 1, in which the light sources (10) comprise at least one LED.

12. Surgical lighting device according to claim 1:

wherein each NIR filter has a transmittance of 0.5% or less within said wavelength band, and wherein the wavelength band spans at least 50 nm.

13. Surgical lighting device according to claim 1:

wherein each NIR filter has a transmittance of at most 0.5% within said wavelength band, and a transmittance of at least 85% within a transmission band, the transmission band spanning at least from 400 nm up to approximately a lower limit of the wavelength band.

14. A surgical lighting device according to claim 1:

wherein when the plurality of NIR filters (18) are in front of the respective light sources (10), the lighting device provides central lighting (Ec) of at least minus 40,000 lux at a center of a light spot one meter from the exit side of the operating light, while also providing a transmittance of not more than 0.5% in said wavelength band.

15. A surgical lighting device according to claim 1:

wherein the lighting device has a maximum central lighting (Ec) of 160 Klux, and has an irradiance in the 700 nm to 750 nm wavelength band of at most 1000 $mW/m^2$.

16. Surgical lighting device according to claim 1:

wherein the lighting device has a maximum central lighting (Ec) of 160 Klux, and has an irradiance in the 750 nm to 850 nm wavelength band of at most 100 $mW/m^2$.

17. A surgical lighting device (1) for use in combination with a fluorescence imaging device during surgery, said lighting device (1) comprising:

a support structure (2), a plurality of light sources (10) for emitting white light, a plurality of NIR filters (18), each NIR filter being associated with a light source (10) and being configured to substantially prevent transmitting wavelengths within a wavelength band, the wavelength band being a range of at least 50 nm located between 680 nm and 900 nm, wherein each of the plurality of NIR filters (18) is movable between (i) an active position, in which the respective NIR filters are each located in front of a light source (10) to filter the light emitted by said light source (10), and (ii) an inactive position in which said plurality of NIR filters do not filter the light coming from the light sources (10), the device further comprising a control unit (24) configured to control movement of the plurality of NIR filters (18) between said active and inactive positions, wherein the control unit (24) is configured to control movement of the plurality of NIR filters (18) between the inactive position and the active position in response to a signal indicating that the fluorescence imaging device has been activated.

18. A surgical lighting device according to claim 17, wherein the plurality of NIR filters are carried on a movable means;

wherein the movable means also carries a plurality of open spaces or a plurality of optical elements other than the NIR filters;

wherein the control unit controls movement of the movable means to move the plurality of NIR filters from the active position to the inactive position.

19. A surgical lighting device (1) for use in combination with a fluorescence imaging device during surgery, said lighting device (1) comprising:

a support structure (2), at least one light source for emitting white light, at least one NIR filter (18), each NIR filter being associated with a light source (10) and being configured to substantially prevent transmitting wavelengths within a wave-length band, the wavelength band being a range of at least 50 nm located between 680 nm and 900 nm, wherein the at least one NIR filter (18) is movable between (i) an active position, in which the at least one NIR filter is located in front of a light source (10) to filter the light emitted by said light source (10), and (ii) an inactive position in which said at least one NIR filter does not filter the light coming from the light sources (10), the device further comprising a control unit (24) configured to control movement of the at least one NIR filter between said active and inactive positions, wherein the control unit (24) is configured to control movement of the at least one NIR filter (18) between the inactive position and the active position in response to a signal indicating that the fluorescence imaging device has been activated.

* * * * *